United States Patent [19]

DiBlasio

[11] 4,275,874

[45] Jun. 30, 1981

[54] EXTENDED STACKER

[75] Inventor: John A. DiBlasio, Medford, N.J.

[73] Assignee: Brandt-Pra, Inc., Cornwells Heights, Pa.

[21] Appl. No.: 13,558

[22] Filed: Feb. 21, 1979

[51] Int. Cl.[3] ..... B65H 29/40; B65H 31/14

[52] U.S. Cl. ..... 271/4; 271/178; 271/187; 271/315; 271/219

[58] Field of Search ..... 271/187, 315, 178, 4, 271/5, 6, 184, 185, 186, 177, 83, DIG. 9, 219; 414/32, 81

[56] References Cited

U.S. PATENT DOCUMENTS

| | | | |
|---|---|---|---|
| 1,827,259 | 10/1931 | Peirce | 271/4 |
| 3,162,438 | 12/1964 | Perry | 271/187 |
| 3,771,783 | 11/1973 | McInerny | 271/125 |
| 3,912,255 | 10/1975 | McInerny | 271/187 X |
| 4,052,053 | 10/1977 | Hasegawa et al. | 271/187 |

*Primary Examiner*—Bruce H. Stoner, Jr.
*Attorney, Agent, or Firm*—Weinstein & Sutton

[57] ABSTRACT

A stacker for handling and counting documents such as, for example, paper sheets, paper currency and the like in which the documents are fed from an input tray through cooperative feeder and stripper assemblies which separate the documents to feed them in a one at a time fashion in a forward feed direction toward acceleration rollers which accelerate the single-fed documents to create a gap between documents moving along the feed path. A gap detector senses the presence of gaps for document counting purposes. An endorser and/or suspect examination detector for examining the authenticity of paper currency may be provided downstream of the first acceleration rollers. The stacker comprises second acceleration rollers cooperating with a guide plate which reverses the direction of movement of the paper documents passing through the endorser station to further accelerate the documents and urge them along a convex guide path and into the pockets of a document receiving stacker wheel assembly which delivers the documents to a stacker tray positioned substantially beneath the infeed stacker to facilitate removal and handling of stacked documents.

22 Claims, 9 Drawing Figures

EXTENDED STACKER

BACKGROUND OF THE INVENTION

The present invention relates to currency and document handling and counting devices and more particularly to a device of the above type having a novel stacker arrangement.

Currency and document handling and counting apparatus find wide-spread use such as, for example, in banks and other commercial as well as industrial establishments and in institutions wherein it is desired to count large stacks of sheets which may include, for example, coupons, bank checks, paper currency and the like. It is important to provide apparatus capable of accurately counting and stacking such sheets at high rates of speed, which sheets may be accurately counted even in light of the fact that they may be slightly or severely mutilated or creased.

It is also important to provide apparatus capable of performing functions beyond counting such as endorsing and/or cancelling documents such as checks, coupons and/or capable of examining paper currency for authenticity.

Apparatus presently available for accomplishing these objectives are described, for example, in the following U.S. patents:

U.S. Pat. No. 3,771,783 issued Nov. 13, 1973 discloses document handling and counting apparatus for receiving a stack of sheets, separating, counting and restacking said documents, and employing an outfeed stacker arranged in that the documents delivered thereto are further removed from the operator than the infeed stacker;

U.S. Pat. No. 3,912,255 issued Oct. 14, 1975 teaches document handling and counting apparatus substantially similar to that disclosed in the above-mentioned U.S. Pat. No. 3,771,783 and in which the outfeed stacker is modified to incorporate rotating fan-like wheel assemblies adapted to receive documents from cooperating acceleration means and deliver and stack the documents upon a swingable stacker plate, said documents being delivered to a stacker plate occupying an interior position within the apparatus which is further removed from the operator than the most conveniently located infeed stacker; and U.S. application Ser. No. 618,280 filed Sept. 30, 1975, now U.S. Pat. No. 4,054,092, and directed to a stacker assembly for separating, counting and stacking documents, the outfeed stacker incorporating a swingably mounted stacker guide plate for directing sheets toward a stacking surface and somewhat loosely retaining the stacked sheets. In this apparatus, the guide plate must be lifted to remove the stack of sheets.

The above patent application and patents are assigned to the assignee of the present invention.

The first-mentioned U.S. Pat. Nos. 3,771,783 and 3,912,255, teach apparatus in which documents leaving the input tray are fed inwardly and downwardly where they are ultimately collected in the outfeed stacker.

Due to the fact that the stackers in the two last-mentioned U.S. Pat. Nos. 3,771,783 and 3,912,255 are arranged deeply within the apparatus interior, operators have generally expressed a fear of injury from the constantly rotating components incorporated in the apparatus and are quite reluctant to reach in and remove stacks of documents from the outfeed stacker.

In addition to the above negative comments, it is also important to provide the aforesaid apparatus with the capability of cancelling and/or endorsing documents such as checks and/or apparatus for examining documents, such as paper currency, for authenticity.

In the case of the above-mentioned copending patent application Ser. No. 618,280, it is inconvenient to utilize the outfeed stacker guide plate which, if lifted during a counting operation, will permit documents to be unnecessarily ejected from the apparatus.

BRIEF DESCRIPTION OF THE INVENTION

The present invention is characterized by providing a novel outfeed stacker assembly which is characterized by providing apparatus for collecting and neatly stacking documents after having undergone counting and/or endorsement and/or examination for authenticity wherein the documents are neatly stacked and said stack is easily and readily accessible to an operator without either moving or lifting any member of the stacker apparatus and at a physical location which is as convenient to use and accessible as the infeed stacker.

In a first preferred embodiment, the invention comprises a stacker assembly which receives documents which have been counted and/or examined for authenticity and/or printed upon, said documents being delivered to the outfeed stacker assembly by positive drive means.

The outfeed stacker assembly includes a guiding surface, preferably a guide plate, which serves to guide the documents directed thereto by first acceleration means towards a second acceleration means, which guide plate and second acceleration means cooperate to alter the direction of the feed path. The second acceleration means includes a driven acceleration roller and a cooperating idler which are aligned to form a nip to urge documents passing therethrough against a further guide surface which serves to again alter the direction of the movement of the sheets moving therealong so as to generally move sheets in a direction outwardly from the interior of the document handling apparatus toward an easily accessible location.

The document guiding surface is generally S-shaped in one preferred embodiment and cooperates with a stacker wheel assembly preferably comprised of a pair of rotating stacker wheels each having cooperating curved resilient fingers adapted to receive documents delivered thereto and to deliver said documents to the cooperating stacker guide tray and slidably mounted stacker guide plate which stacked documents delivered thereto are arranged in a substantially upright position.

Operator contact with the second acceleration means is prevented by the location of the acceleration idler. This idler is lightly spring loaded to permit slipping in the event that a driving nip provided in the document handling and counting apparatus and positioned just upstream of the second acceleration means imparts a different speed to a document simultaneously passing through both nips. The acceleration idler operates in a manner so as to prevent the operator's fingers or other foreign objects from being drawn in to the apparatus.

The second acceleration means and acceleration idler are arranged to form a nip to urge the leading edge of documents passing through the nip against the concave surface of the document guide means as the leading edge passes through said nip to assure positive feeding of the documents into the pockets formed by the aforementioned stacker wheels. Sheets moving through said nip move along an imaginary line representing the tangent to the point of contact between the surfaces of the acceleration means and the acceleration idler. This line forms an acute angle with the surface of the guide means at the point of engagement between the concave surface and the leading edge of a sheet which angle is in the range of from 0° to 30° and preferably is no greater than 20°. This arrangement assures that even curled or creased documents will be fed into the pockets of the stacker wheels. The longer the document length, the greater the aforementioned angle may be.

The separation distance between the nip formed by the second acceleration means and acceleration idler and the pockets formed by the resilient fingers of the stacker wheels assure that each document is urged deeply into each pocket.

The linear speed imparted to the documents by the final acceleration means is of the order of three times the linear speed of the tips of the aforementioned resilient fingers in the region of entry of a document into a pocket to assure insertion of each document into a pocket and to further assure that each document is urged deeply into its pocket.

A stacker tray serves to sequentially strip documents from the pockets of the stacker wheels which documents are then urged against a slidably mounted biased stacker plate by the fingers of the stacker wheels. The tray is positioned to permit a stack of documents collected on the tray to be easily gripped for removal by an operator without coming into contact with the aforementioned resilient fingers. The configuration of the fingers and the direction of rotation of the stacker wheels is such that the fingers move and extend in a direction opposite their direction of movement to prevent injury to an operator even in the event that an operator accidentally touches the stacker wheels. Said fingers are also formed of a resilient yieldable plastic material which further protects an operator against injury, even in the event that the operator accidentally contacts said yieldable fingers.

In an alternative embodiment, the outfeed stacker assembly comprises means for receiving documents otherwise fed in a diagonally upward direction out of document handling and counting apparatus of the type described in application Ser. No. 618,280, and drives the documents delivered thereto by final acceleration means which alters the direction of movement of the documents so as to feed the documents slightly downwardly and against subsequent guide means which again reverses the direction of document feed generally diagonally upward and into the pockets formed between resilient fingers of rotary stacker wheels of the type described hereinabove with respect to the first preferred embodiment.

The aforementioned sheets are driven deeply into the pockets of said rotary wheels by said final acceleration means.

The rotating stacker wheels deliver the collected documents to a cooperating stacker tray and slidably mounted stacker plate which cooperate to support the documents in a generally upright manner to facilitate gripping of the stack of documents for removal from the outfeed stacker without coming into contact with the flexible fingers of said rotary wheels. As was mentioned hereinabove with respect to the first preferred embodiment, the resilient fingers are formed of a lightweight yieldable plastic material which, together with the orientation of the fingers and their direction of rotation, cooperate to prevent injury to an operator who accidentally comes into contact with the fingers.

The final acceleration means of the aforesaid alternative embodiment comprises acceleration idlers which prevent an operator from coming into contact with the driven accelerator roll. In addition, the driven final acceleration means and acceleration idlers are positioned substantially on the diametrically opposite side of said stacker wheels to effectively eliminate any possibility of an operator making contact with the final acceleration means.

The stacker wheel assemblies are formed of a lightweight plastic material and include a circular wheel member having equally angularly spaced eyelet shaped openings for receiving cooperating ends of the yieldable blade members which are each force-fittingly inserted into said eyelet shaped openings.

OBJECTS OF THE INVENTION AND BRIEF DESCRIPTION OF THE FIGURES

It is therefore one object of the present invention to provide a novel stacker assembly for receiving and neatly stacking sheets delivered thereto so as to be easily accessible for removal and with substantially no opportunity for causing injury to an operator in removing stacked sheets therefrom.

Another object of the present invention is to provide an outfeed stacker of the type described wherein acceleration means are provided to abruptly urge the documents against a concave guide surface preparatory to insertion of the document into a pocket formed by a rotary wheel assembly forming part of the stacker.

Still another object of the present invention is to provide a novel outfeed stacker assembly for use in document handling and counting apparatus wherein the arrangement provides an extended feed path along which documents are guided to enable performance of additional operations upon said documents as well as to providing for an outfeed stacker location which greatly facilitates access to said documents for gripping and removal by an operator.

Still another object of the present invention is to provide a novel outfeed stacker assembly for use in document handling and counting apparatus in which the document path is altered to facilitate the formation of an upright easily accessible outfeed stack which may be easily gripped for removal by an operator without manipulating and/or moving any member of the document handling and counting apparatus even during continued stacking of documents.

The above as well as other objects of the present invention become apparent when reading the accompanying description and drawings in which.

Figure 6:
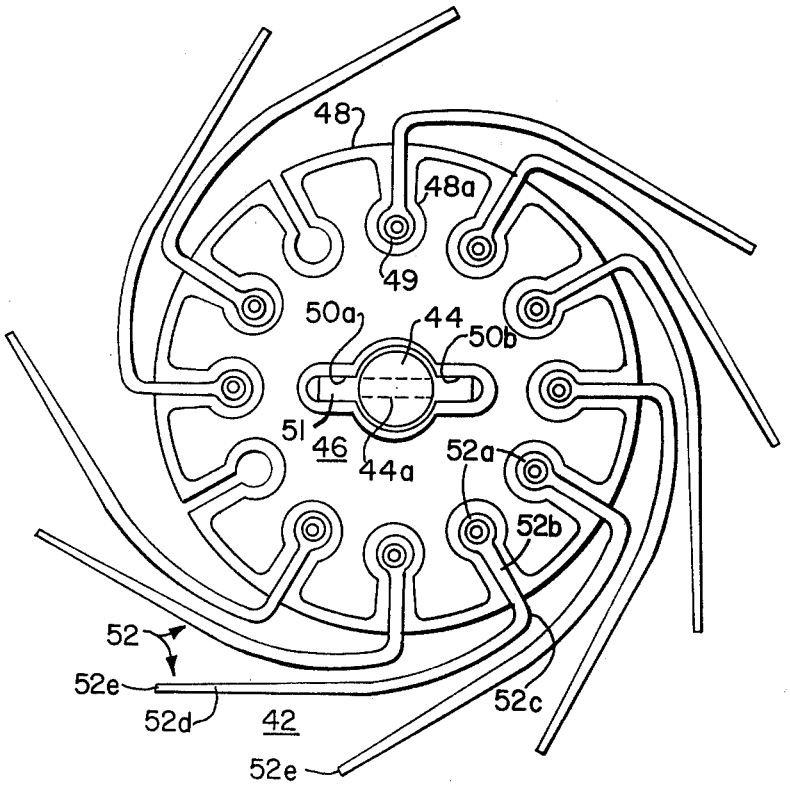
FIG. 6 shows a detailed view of a stacker wheel assembly of the type employed in the preferred embodiment of FIGS. 1 and 3, as well as that shown in FIGS. 4 through 6.
Figure 7:
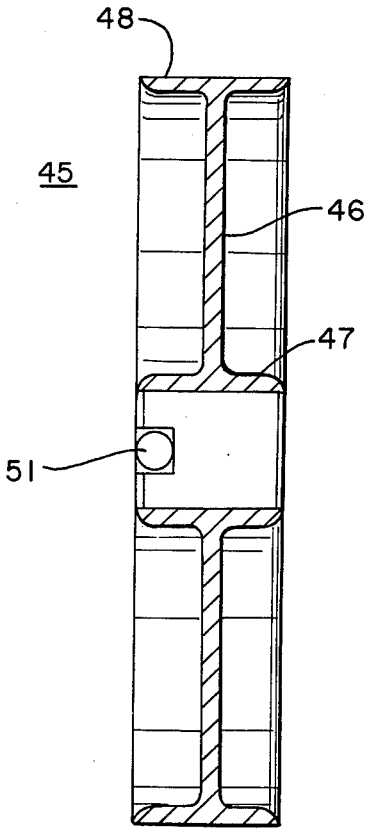
FIG. 7 shows a sectional view of the stacker wheel portion of FIG. 6.
Figure 8A:
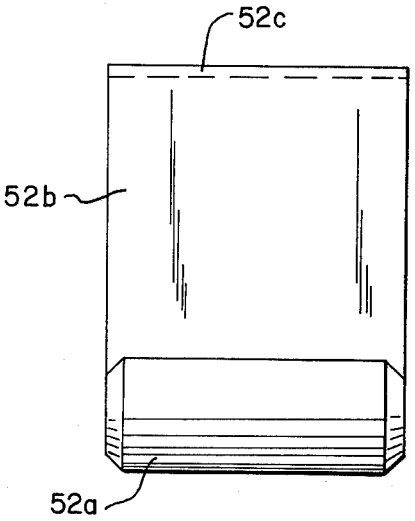
Figure 8B:
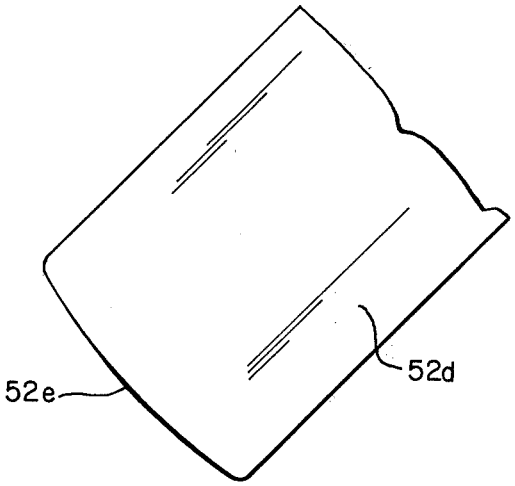

FIGS. 8*a* and 8*b* show end and partial top views respectively of the blades employed in the stacker wheel of FIG. 6.

DETAILED DESCRIPTION OF THE INVENTION AND THE PREFERRED EMBODIMENTS THEREOF

Figure 1:
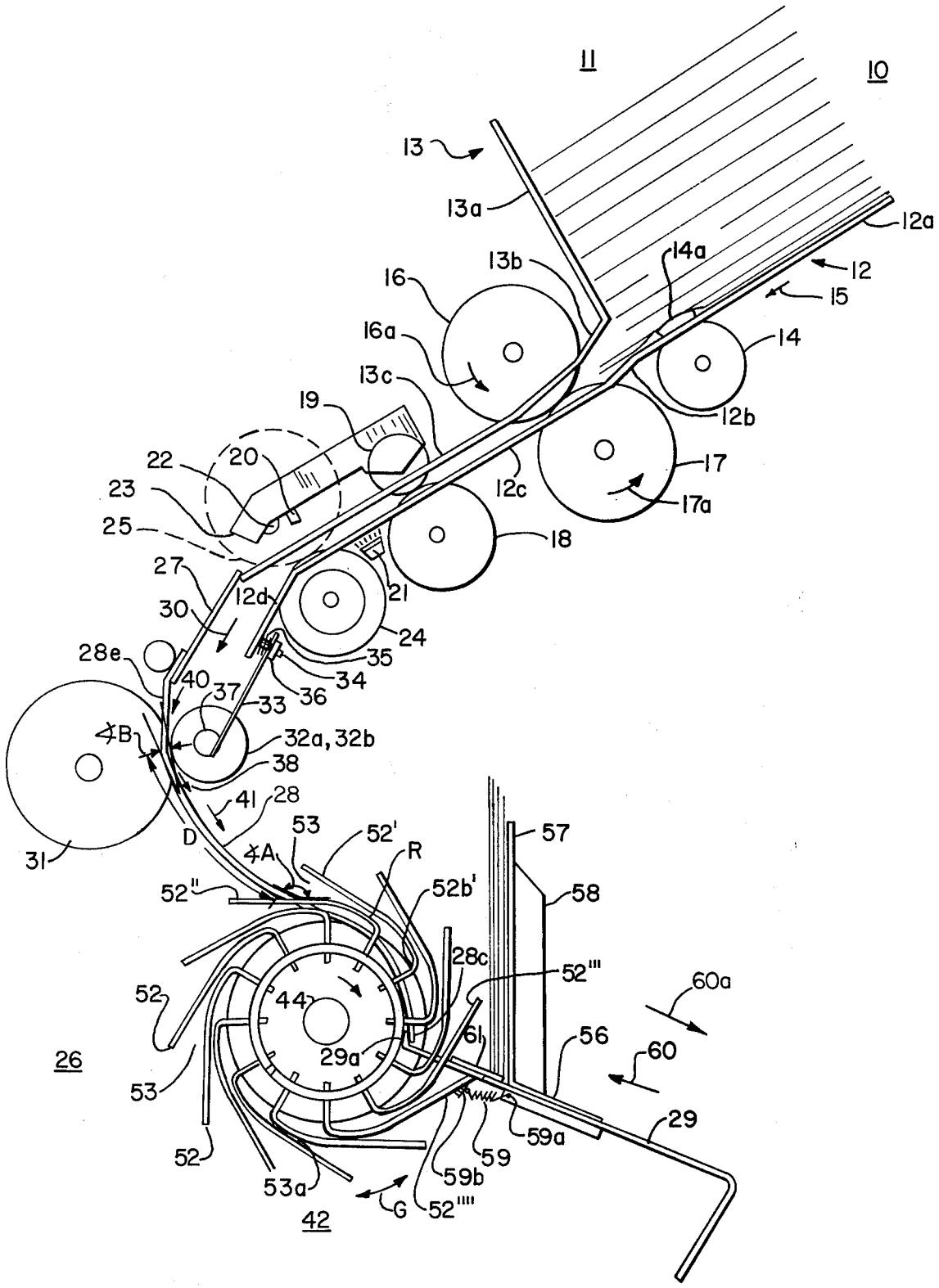
FIG. 1 shows an elevational view of document handling and counting apparatus incorporating an outfeed stacker assembly embodying the principles of the present invention.
Figure 2:
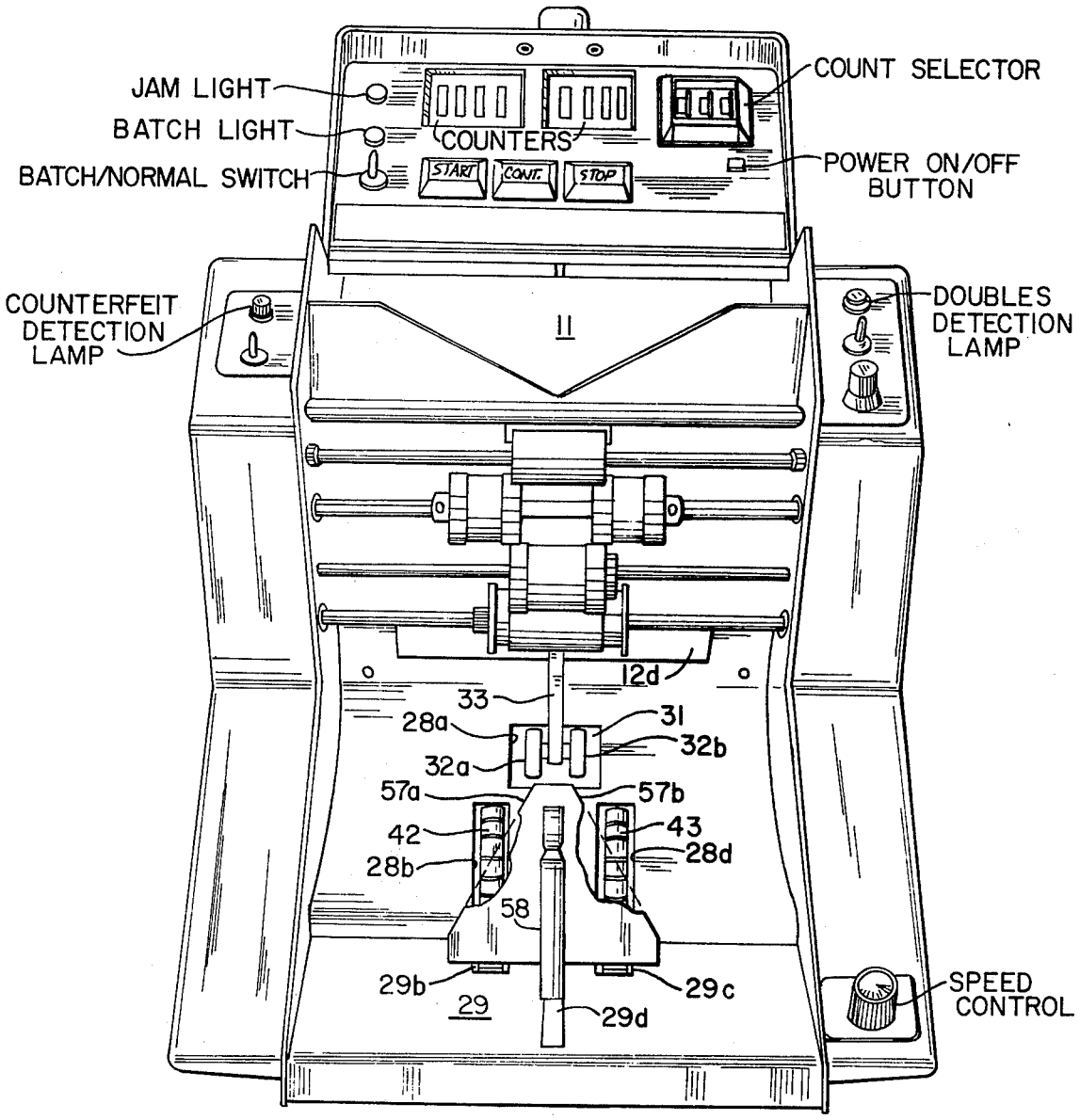
FIG. 2 shows a front perspective view of the apparatus of FIG. 1 showing the most significant components thereof to facilitate a better understanding of the invention.

FIGS. 1 and 2 show a document handling and counting apparatus 10 incorporating a stacker 26 embodying the principles of the present invention and being comprised of electromechanical apparatus adapted to count paper currency, checks, coupons, and other like documents and which is further capable of endorsing or cancelling such documents as well as aiding in the detection of counterfeit U.S. notes (i.e. paper currency).

Major components of the apparatus 10 are basically similar to those described in detail in the aforementioned U.S. Pat. No. 3,771,783 and therefore a detailed description of the invention will be omitted for purposes of simplicity, reference being had to the last-mentioned U.S. patent which is incorporated herein by reference thereto.

Briefly describing the major components of the invention, the apparatus 10 is a substantially lightweight device capable of being positioned upon any table or suitable support surface. Further, the apparatus 10 comprises an input tray 11. Portion 12*a* of an elongated guide plate 12 serves as a supporting surface for the stack of documents. A second elongated guide plate 13 has a portion 13*a* which supports the leading edges of the documents as shown.

The guide plate portion 12*a* is provided with an opening through which a portion of constantly rotating picker roller 14 extends. The picker roller 14 is provided with a raised surface portion 14*a* which periodically protrudes through the afore-mentioned opening to regularly "jog" the stack of documents and to feed the bottommost sheet in the forward feed direction represented by arrow 15. The raised surface portion 14*a* of picker roller 14 is preferably formed of a material having a durometer to facilitate driving of sheets in the forward feed direction.

Portions 13*b* and 12*b* of guide plates 13 and 12 form a narrow entrance throat serving as an entrance passageway for the bottommost sheet of the stack. Leading edges of sheets passing through the entrance throat enter into the nip formed between constantly rotating stripper roller 16 and feed roller 17, the arrows 16*a* and 17*a* representing the direction of rotation of rollers 16 and 17 respectively. The operation of the cooperating stripper and feed rollers is described in detail in the aforementioned U.S. Pat. No. 3,771,783 and therefore a detailed description will be omitted herein. It is sufficient to understand that rollers 16 and 17 partially extend through cooperating openings (not shown) in their respective guide plates 13 and 12 so as to form a nip into which sheets delivered from the input tray enter. The durometers of the rollers 16 and 17 are selected so as to allow roller 17 to impart the greater frictional driven upon a single fed sheet while the durometer in the material of roller 16 imparts a lesser frictional drive upon the same sheet so that the resultant force acts to drive sheets in the forward feed direction 15. In the case of double-fed sheets, the friction between the engaging double-fed sheets is less than the friction between stripper roller 16 and the upper sheet so that the bottommost sheet is fed in the forward feed direction while the topmost sheet of the double-fed sheets is urged rearwardly towards the input tray 11. It can thus be seen that the rollers 16 and 17 function to permit only single-fed sheets to pass downstream in the forward feed direction beyond rollers 16 and 17.

A constantly rotating upper acceleration roller 18 and cooperating upper acceleration idler roller 19 partially extend through openings in portions 13*c* and 12*c* of guide plates 13 and 12 to form a nip through which sheets moving in the forward feed direction and delivered by rollers 16 and 17 are caused to pass. The upper acceleration roller 18 imparts additional drive to sheets being fed therebetween so that, once the sheet leaves the influence of the nip formed by rollers 16 and 17, its linear velocity is increased thereby providing an increased separation distance between the trailing edge of the sheet fed therethrough and the leading edge of the next sheet to be fed therethrough. This gap is detected by a document detector and doubles detector sensing means 20 cooperating with light source 21. Of course, it should be understood that an opening (not shown) is provided in each of the guide plate portions 12*c* and 13*c* to permit light from light source 21 to pass through guide plates 12 and 13 and be picked up by sensor 20. Light of maximum intensity is sensed by sensor 20 as a gap between documents passes therebetween. Light of increased intensity causes the sensor 20, which may preferably be a photodiode or phototransistor, to generate a signal, typically in the form of a pulse, which is used for counting purposes. This basic technique is described in detail in U.S. Pat. No. 3,771,783.

The doubles detection capability is provided to sense the presence of double-fed documents by sensing a light intensity condition which is reduced as compared with the light intensity detected by sensor 20 in the presence of a single document. Suitable apparatus for accomplishing this result is set forth in copending application Ser. No. 865,316 filed Dec. 28, 1977 and assigned to the assignee of the present application. Since the specific nature of such apparatus is beyond the scope of the present application and since the invention described hereinbelow does not rely upon the nature of such devices for its successful operation, a detailed description of the apparatus will be omitted for purposes of simplicity and the description of the doubles detection capability described in the last-mentioned copending application is incorporated herein by reference thereto. It is sufficient for purposes of the present invention to understand that the doubles detection device may either provide a visual or audible alarm indicative of a doubles condition or may additionally provide means for shutting off the document handling apparatus 10 in the presence of a double-fed condition as detected by sensing means 20.

In the event that it is desirable to examine paper currency for authenticity, the document-handling apparatus 10 may further be provided with an ultraviolet (UV) lamp source 22 which cooperates with an opening (not shown) in guide plate 13 to allow light from the ultraviolet source to irradiate documents passing therebeneath. An ultraviolet sensor 23 detects light reflected from the irradiated documents and, as described in copending application Ser. No. 711,436 filed Aug. 4, 1976, now U.S. Pat. No. 4,114,804 and assigned to the assignee of the present invention, indicates the presence of a suspect bill. For purposes of the present invention, it is sufficient to understand that the wavelength of light emitted from an authentic piece of paper currency is different from the wavelength of light emitted from nonauthentic (i.e. suspect) paper currency. Sensor 23 monitors this condition and either generates an alarm indicative of the presence of a suspect bill or halts the document feeding operation, or both.

The document handling and counting apparatus 10 may be provided with the further capability of printing on documents being processed. The apparatus 10 is thus provided with a constantly rotating platen roller 24 cooperating with a rotatable endorsing drum 25. Suitable openings (not shown) are provided within guide plates 12 and 13 in the region of the endorsing facility. Portions of the platen roller 24 and endorsing drum 25 partially extend through the aforesaid openings to form a nip through which single-fed documents pass so as to permit printing thereon. One endorsing assembly including an endorsing drum is described in detail in copending application Ser. No. 618,280 referred to hereinabove. For this reason, a detailed description will be omitted herein for purposes of simplicity, application Ser. No. 618,280 being incorporated herein by reference thereto. The endorser drum 25 may be selectively moved into or displaced from the printing position. Typically, a fixed legend and/or a variable legend (typically comprised of month, day and year information) is caused to be printed on one side of a document passed therethrough. The apparatus may be employed to either cancel or endorse documents. When cancelling documents, the documents are introduced into the input tray 11 of the document handling apparatus 10 so that the legend printed by drum 25 appears upon the front or face side of the document. By reversing the alignment of documents, they may be endorsed so that the legend appears on the rear side of the documents. When it is desired to process documents without either endorsing or cancelling, a suitable lever (not shown) is provided for displacing the endorsing drum 25 from the printing position. Platen roller 24 serves as a supporting surface for supporting the documents during printing.

Comparing the document handling and counting arrangement as shown, for example, in FIG. 1*a* of U.S. Pat. No. 3,912,255 and that shown in FIG. 1 of U.S. Pat. No. 3,771,783, it can be seen that much additional space is required in order to provide all of the added capabilities of doubles detection, suspect detection and endorsing of documents. Thus, the path from the picker roller 14 to the platen roller 24 can be seen to be of significantly increased path length as compared with the path length between the picker roller and the acceleration roller in the apparatus of U.S. Pat. Nos. 3,771,783 and 3,912,255.

In order to provide adequate space within the apparatus 10 without increasing the overall size of the said apparatus, the present invention provides an outfeed stacker assembly 26 which includes contiguous guide plates 27 and 28 and outfeed stacker tray surface 29. The lower end portion 12*d* of guide plate 12 is bent to form an obtuse angle with guide plate portion 12*c*. Portion 12*d* forms a substantially spaced parallel passageway with guide plate 27 through which documents leaving the nip between endorsing drum 25 and platen roller 24, or leaving the nip between upper acceleration roller 18 and upper acceleration idler 19, in the event the endorsing drum 25 is moved to the displaced position or is omitted altogether. Guide plate 27 is primarily responsible for deflecting the documents entering the passageway in a direction shown by arrow 15 to move in a slightly altered direction as represented by arrow 30 so as to enter into the nip formed between constantly rotating lower acceleration roller 31 and cooperating lower acceleration idler 32.

Considering both FIGS. 1 and 2, it can be seen that lower acceleration roller 31 partially extends through an opening 28*a* in guide plate 28; which preferably has a generally S-shaped configuration.

The lower acceleration idler 32 is mounted upon the lower end of a supporting arm 33 which is provided with a suitable opening (not shown) for receiving fastening member 34 having one end joined to guide plate portion 12*d* and extending through the aforesaid opening in arm 33. A helical spring 35 is mounted upon threaded fastening member 34 to provide a resilient mount for arm 33. A fastening nut 36 threadedly engages fastening member 34. A shaft 37 is joined to the lower end of arm 33. The lower acceleration idler 32, as can best be seen in FIG. 2, is in actuality comprised of a pair of rollers 32*a* and 32*b* freewheelingly mounted upon shaft 37 and rotated by virtue of its rolling engagement either with acceleration roller 31 (in the absence of a document) or by rolling engagement with the document passing through the nip formed by acceleration roller 31 and acceleration idler rollers 32*a*, 32*b*.

The rollers 31 and 32 make point contact. The imaginary line representing the tangent between the point of contact between the lower acceleration roller 31 and idler roll 32 is aligned so that the rollers 31, 32 alter the direction of movement of documents from that represented by arrow 30 to that represented by arrow 38 so that the leading edge of a document emerging from the nip between members 31 and 32 moves abruptly toward engagement with the curved guide plate 28 almost immediately after leaving the aforesaid nip. The angle B at the point of contact between a leading edge and the tangent to the concave surface portion of guide plate 28 is preferably in the range from 10°–30° to prevent even curled documents from becoming airborne and flying out of the apparatus and away from the stacker wheels 26. Acceleration roll 31 further accelerates the documents so as to increase the linear speed of the document beyond that imparted to the documents by the cooperating roller assemblies arranged upstream relative to the lower acceleration roller 31 and its cooperating idler 32. Preferably, the linear velocity imparted to sheets passing between endorsing drum 25 and platen roller 24 is substantially equal to that imparted to the sheets by upper acceleration roller 18 and its cooperating idler 19. The upper acceleration idler 19 is resiliently mounted to enable a sheet also passing through the nip between rollers 18 and 19 to experience slippage relative to the nip formed by cooperating roller 24 and drum 25 to preventing smearing during printing. Although lower acceleration roller 31 imparts an increase in linear velocity to documents entering the nip between members 31 and 32, the resilient mount of idler rollers 32*a* and 32*b* permits sheets moving into the nip formed by members 31 and 32 to undergo some slippage relative to the movement of the same sheet between roller 24 and drum 25, for the purpose of preventing smearing during printing, as well as preventing the sheets from being torn or otherwise damaged.

Curved guide plate 28 alters the path of sheets leaving nip 40 still further, as is represented by curved arrow 41, so that documents originally introduced into the document counting and handling apparatus 10 and moving generally downwardly and to the left have their path of movement significantly altered so as to be moving diagonally downward and to the right. The angle of the force imparted to sheets passing through nip 40 which drives documents toward guide plate 28 cooperates with the concave curvature of guide plate 28, to cause the sheets to follow closely along the aforesaid concave surface and thereby assures entry into one of the pockets of the constantly rotating stacker wheel assemblies 42 and 43 which are mounted upon a common shaft 44.

Since both stacker wheel assemblies are substantially identical in design and function, only one will be described herein in detail for purposes of simplicity. Making reference to FIGS. 6, 7, 8*a* and 8*b*, the stacker wheel assembly can be seen to be comprised of a circular-shaped stacker wheel 45, have a disc-shaped portion 46 provided with a central opening defined by an integral short cylindrical shaped hollow portion 47. The outer periphery of disc 46 has an integral cylindrical shaped flange 48. A plurality of eyelet shaped openings 49 are arranged at equally spaced angles about the wheel 45, said openings extending into the peripheral flange 48. In order to lock the wheel 45 to common shaft 44, an elongated recess is provided which is defined by said central opening and recess portions 50*a* and 50*b*, said recess portions being arranged along one diameter of the wheel and on diametrically opposite sides of shaft 44 which is preferably provided with an opening 44*a* for extending a pin 51 therethrough, which pin is then force-fitted into recesses 50*a* and 50*b* to lock wheel assembly 42 to rotate in unison with common shaft 44.

A plurality of stacker wheel fingers 52 are force-fittingly mounted to wheel 45 and, are comprised of a dowel shaped portion 52*a* joined to a radially outwardly directed straight or linear portion 52*b* which is bent at 52*c* where it merges with a curved outermost finger portion 52*d*. The stacker wheel finger assemblies 52, as well as wheel 45, are preferably formed of a suitable plastic material such as, for example, a thermoplastic polycarbonate resin such as LEXAN, a registered trademark of General Electric Company. Obviously any other material exhibiting similar characteristics may be employed. The material imparts sufficient resiliency and yieldability to fingers 52. However, the wheel 45, although preferably made of the same material, is rigidified by virtue of the inner and outer integral flanges 47 and 48. It should be understood that flange 48 includes portions 48*a* thereof which are integral with the peripheral portion 48 and surrounding each eyelet shaped opening 49 to impart further rigidity to wheel 45 and to provide adequate surface contact between fingers 52 and wheel 45 to obtain the desired force-fit.

Adjacent fingers 52 cooperate to form a curved passageway or pocket 52 into which documents are caused to enter due to curvature of the guide plate 28 and the relative angular velocities of acceleration roller 31 and stacker wheels 42 and 43. The relative rotating speeds of acceleration roll 31 and wheels 42 and 43 are chosen so that the acceleration wheel imparts a linear velocity which is substantially three times greater than the linear velocity of the outer tips 52*e* of fingers 52. The relative linear velocities need not be precisely in a three to one relationship and may extend over the range from 2.3 to 1 to 3.7 to 1. The preferred ratio, together with the distance D between nip 40 and the tips 52*e* of resilient fingers 52 is selected to insure that documents are positively urged deeply into the aforesaid pockets 53. This distance D and the length of the pocket defined by finger portions 52*d* determine the size of documents which may be stacked. The aforementioned linear speed ratio assures that each document enters into one of said pockets 53. The entrance gap G1 between the free ends 52*e* of adjacent fingers 52 and the shape of curvature of the fingers 52 imparts a flexing and a curvature to documents entering the aforesaid pockets 53. The curved shape of adjacent fingers 52 defining pockets 53 decelerate the document as it enters the pocket 53. When fully entered into a pocket 53 a document generally assumes the longitudinal shape of the pocket 53 defined by said pair of adjacent fingers 53. The curvature imparted to the sheets together with the deceleration imparted to a sheet as it enters into the pocket cooperate to prevent the sheet from bouncing back out of a pocket once its leading edge has bottomed against the radial portion 52*b* of a cooperating finger 52. Bottoming of documents is assured by proper selection of the aforementioned distance D, the length and curvature of the curved finger portions 52*d* and the aforementioned velocity ratio for a particular document length, said length being measured in the forward feed direction. The width of the entry opening of a pocket 53 is greater than the width of the mid portion of the pocket to enable even sheets having a curled leading edge to enter the pocket and to bottom as well as an uncurled sheet. The distance between fingers at the narrowest portion R of a pocket 53 is chosen to aid in the deceleration of entering sheets and yet to accommodate curled or creased sheets.

The curved guide plate 28 is provided with a large opening 28*b* to provide sufficient clearance for the curved portions 52*d* of fingers 52 to extend therethrough. The portion of guide plate 28 in the region of opening 28*b* can be seen to form a convex curvature which curves generally inwardly toward the longitudinal axis of rotary wheel drive shaft 44 so that its lowermost end portion 28*c* comes closest to the aforementioned longitudinal axis. The lower end portion 28*c* can be seen to overlap with an upwardly extending flange portion 29*a* of tray surface 29. Stacker tray surface 29 has a pair of openings 29*b* and 29*c* cooperating with the openings 28*b* and 28*d* which cooperate to permit the free movement of fingers 52. The surfaces of members 28 and 29 which surround the openings through which the stacker wheels 42 and 43 extend, serve to strip documents previously introduced into pockets 53. This is accomplished as a result of the fact that the leading edge of a document within a pocket 53 comes into contact with the surface of tray 29 surrounding openings 28*b* and 28*d*, preventing documents from experiencing any further movement within a pocket 53 while allowing the fingers to pass beyond the position of the leading edge of the document engaging surface 29 thereby stripping the document from its pocket 53.

Tray portion 29 is further provided with an elongated slot 29*d*. A slidable member 56 which may, for example, have an H-shaped cross-sectional configuration defining two oppositely directed grooves is adapted for embracing opposing marginal portions of elongated opening 29*d* to slidably mount member 56 therealong. Slidable member 56 has integrally joined thereto an upright guide plate 57 having a centrally located gripping portion 58. Guide plate 57 has a substantially triangular-shaped configuration so that rectangular-shaped paper sheets delivered to the outfeed stacker have their opposite ends extending beyond the diagonally aligned sides 57*a*, 57*b* of guide plate 57 to permit the stack of documents to be gripped for removal from the outfeed stacker.

Spring means 59 which may, for example, be a helical spring 59 having its end 59*a* joined to slidable member 56, and having its opposite end 59*b* joined to a portion of the frame of apparatus 10, to normally urge guide plate 57 in the direction shown by arrow 60. The spring loading of the guide plate 56 facilitates the neat stacking of documents of various quantities. A blocking member 61 may be positioned at the upper end of elongated slot 29*d* for limiting the uppermost position which may be occupied by the guide plate 57 in the absence of documents.

The stacking operation occurs as follows:

Sheets enter into the passageway defined by guide plate 27 and guide plate portion 12*d* at a predetermined first velocity and are deflected downwardly and to the left relative to the feed direction 15 to move in the feed direction 30 so as to enter into the nip 40 formed by acceleration roller 31 and acceleration idlers 32*a*, 32*b*. Portion 28*e* of guide plate 28 further serves to guide the leading edge of a document into nip 40. The acceleration roller 31 abruptly increases the linear velocity of a document entering into nip 40. The angle B formed by the tangent to the point of contact between acceleration roller 31 and idler 32 and the tangent to the point along concave surface portion of guide plate 28 just beneath nip 40 which is engaged by a leading edge, is chosen so that the leading portion of a document leaving nip 40 which is urged against concave surface of guide plate 28 forms a small acute angle therewith between 10° and 30° to assure that the document closely follows the concave surface of said plate 28 as it moves toward rotating stacker wheels 42 and 43 and to prevent curled documents from flying out of the apparatus and away from the stacker wheels 42.

As was mentioned hereinabove, the acceleration idler 32 is resiliently mounted to permit the leading portion of a document entering nip 40 to experience some slippage relative to document the trailing portion of the same which is passing through the nip between platen roller 24 and endorsing drum 25 so as to prevent smearing during printing. Additionally, the idler roller 32 substantially "covers" the portion of roller 31 extending through guide plate 28 to prevent an operator from coming into contact with constantly rotating roller 31 and thereby prevents an operator from being injured. Although not shown for purposes of simplicity, a cover plate is provided for covering the roller members 14, 17, 18 and 24 when the document handling apparatus 10 is fully assembled and in use.

The linear velocity imparted to documents by acceleration roll 31 and cooperating idler 32 is preferably three times as great as the linear velocity of the tips of fingers 52 in the region of entry of a document into a pocket 53 to guarantee that each sheet leaving nip 40 is urged deeply into a pocket 53 whereby its leading edge engages the radially aligned portion 52*b* of a finger for example, finger 52″. The confronting convex surface of the adjacent finger 52′ deflects a sheet entering into the opening of a pocket 53 so as to guide it through the narrow region R defined by the confronting surface portions of adjacent fingers 52′ and 52″ which define the narrow region R. Due to the velocity ratio as was mentioned hereinabove, the sheet moves into a pocket 53 so that its leading edge bottoms against the radially aligned portion 52*b*′ of finger 52′ before radially aligned portion 52*b*′ reaches the upper surface of tray portion 29.

The velocity of the documents forwarded to the stacker wheels 42 and the size of the entry opening of each pocket 53 assures that each document will be fed into a pocket without any need whatsoever for synchronizing the positioning of a pocket entry opening with the feeding of a document from the second acceleration means towards the stacker wheels. The curvature of each finger 52 is such that the surface (see FIGS. 1 and 6) of a finger 52 forms an angle A with the surface of the guide plate 28 as the finger tip 52*e* passes through surface 28. The angle A should preferably be in the range of 155° to 165°. This orientation also contributes to positive feeding of each document into a pocket 53 without synchronizing the feeding of documents to the stacker wheels.

The sheet which is entered into the pocket 53 assumes the curvature of the pocket 53 defined by the cooperating fingers 52′ and 52″ which fingers decelerate the entering sheet to prevent the sheet from bouncing back out of the pocket 53 after the sheet has bottomed, enabling the sheet to preferably achieve a stable condition before its leading edge engages tray surface 29. The length of the curved portion 52*c* of a finger is preferably no greater than the length of the shortest document, measured in the feed direction, to assure that all documents delivered to the outfeed stacker will bottom. For example, if a document enters the stacker wheels in a skewed fashion, the length of a pocket 53 is chosen to permit even the shortest length document to realign itself before being stripped from a pocket by the document stripping portion 29 of the stacker tray. The sheet is stripped from the pocket 53 defined by fingers 52′ and 52″ as the leading edge of the sheet engages tray surface 29 while fingers 52′ and 52″ continue to revolve about the axis of rotation of shaft 44 and pass below the surface of tray portion 29 (note fingers 52‴ and 52⁗). As can be seen, the curved portion 52*d*″ of finger 52″ is increasingly further away from the axis of rotation of stacker wheels 42 and 43, measured from radial portion 52*b*′ outward toward tip 52*e*, so that the tip 52*e*″ of finger 52″ engages the left-hand surface of a sheet being stripped from pocket 53 to urge the sheet being stripped towards the left-hand surface of guide plate 57. The extreme tips 52*e* of the fingers 52 can be seen to come closest to the guide plate 57 at a point a spaced distance above the upper surface of stacker tray 29, serving to urge the stripped sheet toward guide plate 57. Subsequent sheets are handled and stacked in the substantially the identical manner. Preferably the tips 52*e* are displaced from guide plate 57 when the stacker is empty.

As the sheets accumulate upon the surface of tray 29 and against guide plate 57, ultimately the thickness of the stack is greater than the distance between the extreme tips of fingers 52 and guide plate 57 causing the resiliently biased guide plate 57 and member 56 to be urged in the direction of arrow 60*a* against the biasing force of spring 59. This arrangement further serves to hold the stack of sheets in a substantially compressed manner, the extreme tips 52*e* of fingers 52 serving to continuously slidably engage the last sheet delivered to the stack being formed in the outfeed stacker and to compress the stacks of sheets.

The sheets may be removed by gripping any portion of the stack, preferably on either side of the diagonally aligned sides 57*a*, 57*b* of substantially triangular-shaped guide plate 57 and simply lifting the stack away from the outfeed stacker. As can be seen from FIG. 2, the stack is arranged at a location which is easily accessible and does not require the operator to place his hand deeply into the machine and thereby greatly increase the risk of coming into contact with moving components which might expose the operator to injury. The stack can be seen to be positioned just beneath the input tray 11 so that removal of sheets is as simple and straightforward in operation as placement of sheets on input tray 11. The design of stacker guide plate 57 permits the accumulated stack to be removed without any manipulation of the guide plate 57. However, if desired, and in the event that sheets are of reduced dimension in the horizontal direction (considering FIG. 1) the guide plate 57 may be moved in the direction shown by arrow 60*a* by gripping the central portion 58 to pull the stacker plate 57 in the direction of arrow 60*a*. However, this is not necessary unless such sheets are extremely small in the horizontal dimension.

Since fingers 52 are highly resilient and yieldable, there is very little danger of injury to an operator who may accidentally come into contact with the fingers. Preferably, the upper left-hand and upper right-hand edges of the stack of documents typically extend well beyond the left and right-hand sides of stacker wheels 42 and 43 respectively to facilitate gripping and removal of a stack of sheets without engaging either stacker wheel.

Figure 4:
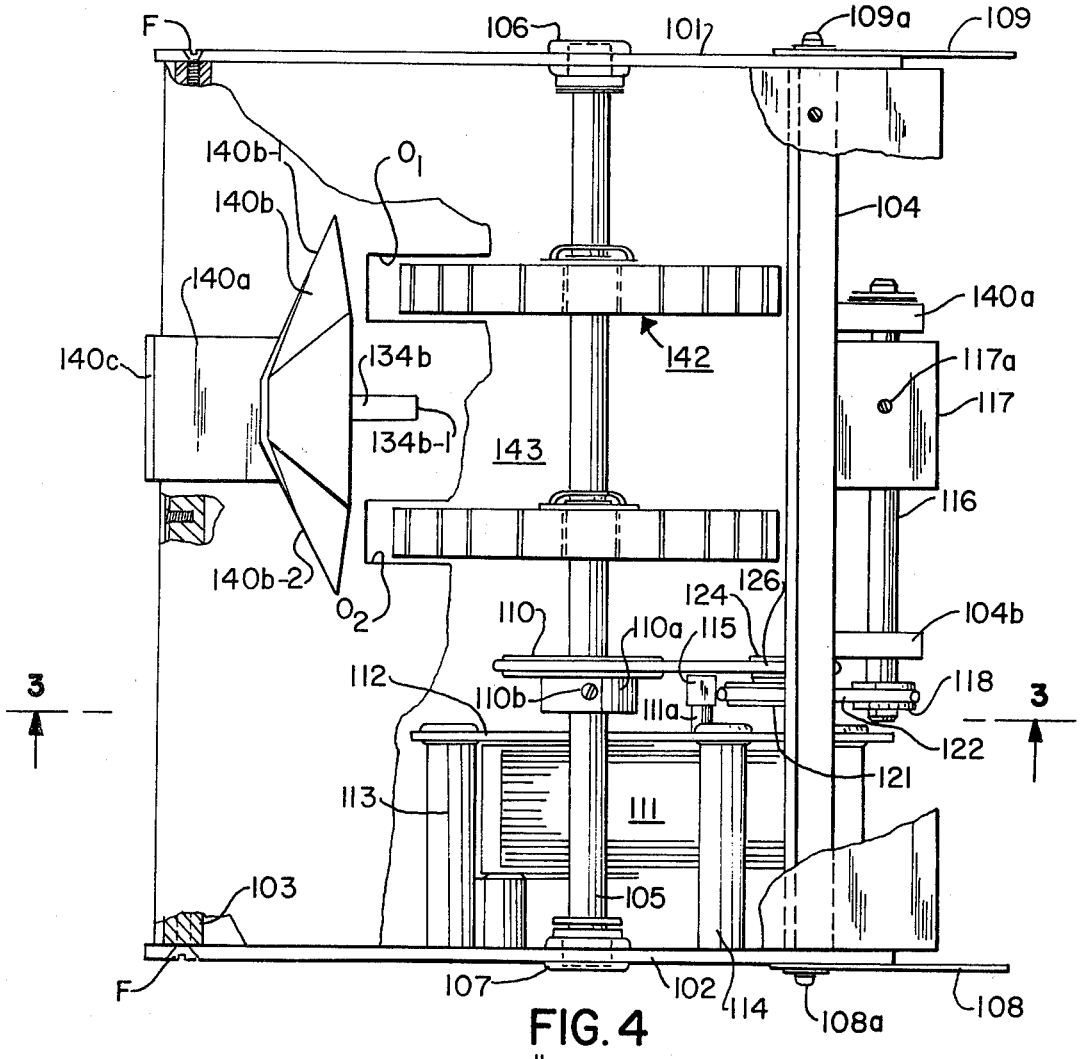
FIG. 4 shows a top plan view of the apparatus in FIG. 3.
Figure 3:
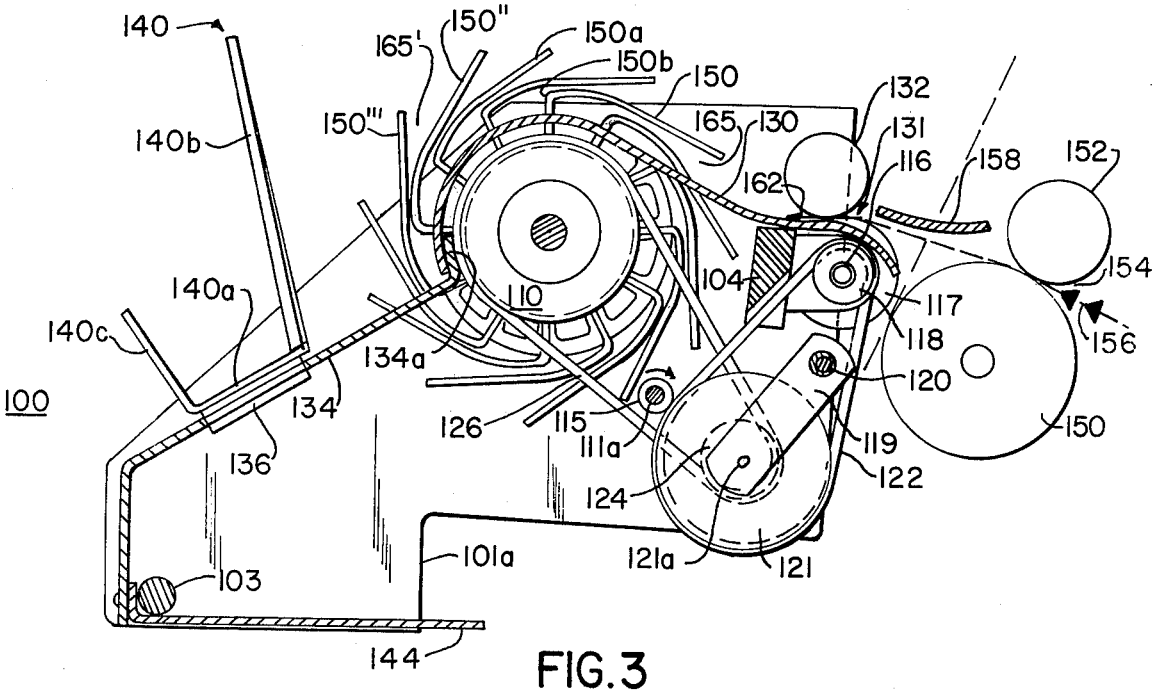
FIG. 3 shows an elevational view, partially sectionalized, of another preferred embodiment of the present invention.
Figure 5:
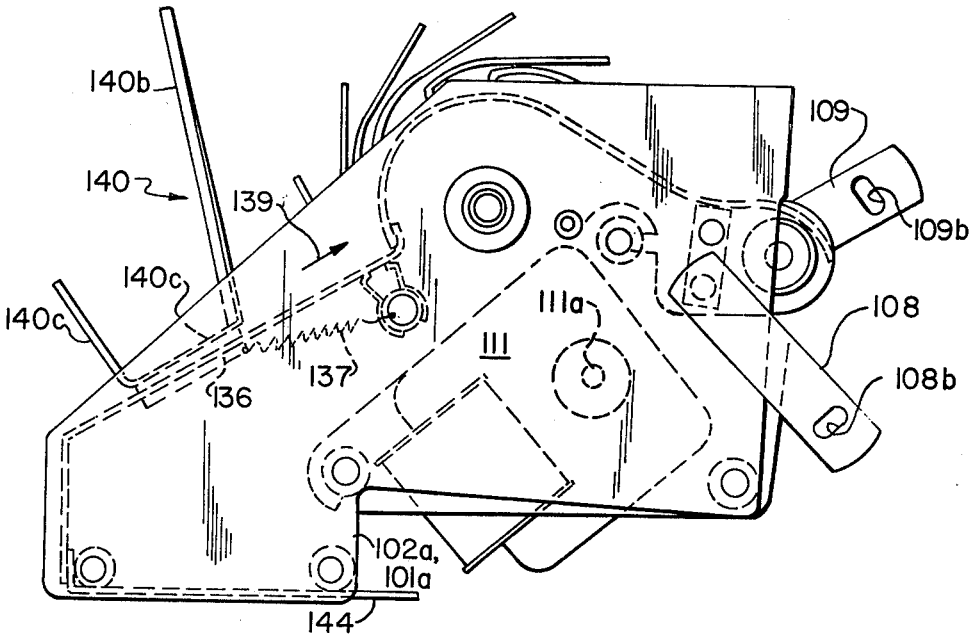
FIG. 5 shows the same elevational view depicted in FIG. 3 with the near side cover plate being mounted thereon.

In the alternative embodiment, as shown in FIGS. 3–5, the stacker arrangement generally resembles that of FIGS. 1 and 2. The stacker assembly 100 shown in FIGS. 3–5 is designed for use with the document handling apparatus shown in detailed FIG. 2*a*, for example, of above-mentioned U.S. application Ser. No. 618,280 wherein the swingably mounted guide plate 111 shown in FIG. 2*a* of the last-mentioned copending application is omitted and is replaced by the stacker assembly 100 as shown in FIGS. 3–5.

Apparatus 100 is comprised of a pair of side plates 101 and 102 joined by suitable elongated spacer members such as members 103 and 104 extending between plates 101 and 102 and having their free ends secured thereto by suitable fastening means F.

A shaft 105 has its opposite ends journaled within bearing assemblies 106 and 107 arranged in suitable openings within plates 101 and 102 respectively. Shaft 105 has rotary stacker wheels 142 and 143 rigidly secured thereto, said stacker wheels being substantially identical in design and operation with the stacker wheels 42 and 43 described hereinabove.

A pulley 110 having a collar 110*a* is mounted on shaft 105 and is locked thereto by set screw 110*b*. A motor 111 is secured between side plate 102 and a smaller mounting plate 112 secured to side plate 2 by suitable spacers such as spacers 113 and 114.

A capstan 115 is mounted upon a free end of motor shaft 111*a*.

A pair of shaft supports 104*a* and 104*b* are secured to the right-hand surface of spacer 104. Each of these projections are provided with suitable openings (not shown) for receiving and supporting freewheeling shaft 116. An acceleration roller 117 is positioned upon shaft 116 and is secured thereto by set screw 117*a*.

A pulley 118 is also mounted upon shaft 116 so as to rotate therewith. Shaft 116 is mounted so as to freewheelingly rotate relative to the shaft support members 104*a* and 104*b*.

An arm 119 is swingably mounted upon the stacker assembly frame by means of a shaft 120 having the upper end of arm 119 pivotally mounted thereon. A pulley 121 is free-wheelingly mounted to the lower end of arm 119. A resilient O-ring 122 is entrained about pulley 118 and pulley 121. The relative positions of the longitudinal axes of pivots 120 and 121*a* and shaft 116 cause O-ring 122 to urge arm 119 clockwise about pivot 120. A second smaller diameter pulley 124 is rotatably mounted at 121*a* to the lower end of swingable arm 119 at common pivot 121*a* so as to be coaxial with pulley 121. A resilient O-ring 126 is entrained about pulley 110 on stacker wheel shaft 105 and small pulley 124 rotatably mounted to the lower end of arm 119. O-ring 126 normally urges arm 119 in the clockwise direction about pivot 120 causing the O-ring 122 to make firm rolling engagement with the surface of capstan 115. Capstan 115 rotates clockwise (see FIG. 3) causing both the large pulley 121 and the pulley 118 to be rotated counterclockwise. The counterclockwise rotation of large pulley 121 is imparted to pulley 110 which rotates shaft 105 and stacker wheels 108 and 109 counterclockwise.

A curved guide plate 130 having an undulating generally Z-shaped configuration is arranged between side plates 101 and 102 and secured thereto by suitable fastening means. The right-hand end of guide plate 130 has a convex curvature which extends beneath the surface of final acceleration roller 117 mounted upon shaft 116. The curved plate 130 then assumes a concave curvature on the downstream side of a nip 131 formed between final acceleration roller 117 and final acceleration idler 132 which is preferably substantially similar in design and function to the acceleration roller 31 and acceleration idler 32 described in the embodiment of FIGS. 1 and 2.

Guide plate 130 then assumes a convex curvature in the region of the stacker wheels 142, 143 so that its outer convex surface has a diameter preferably no greater than the diameter of the outer periphery 48 of the rotary wheel 45 such as, for example, the stacker wheel 45 as shown in FIG. 6.

The downstream end of guide plate 130 overlaps with an upwardly directed flange 134*a* provided at the upstream end of stacker tray 134. The stacker tray 134 cooperates with guide plate 130 to form two narrow substantially elongated rectangular shaped openings $O_1$ and $O_2$ to permit the revolving fingers 150 of the rotary wheels 108 and 109 to freely pass therethrough.

Tray 134 is further provided with a narrow elongated rectangular shaped slot 134*b*. Member 136, having a substantially H-shaped cross sectional configuration is mounted within slot 134*b* so that its two inwardly directed grooves slidably embrace marginal portions of the two long sides of slot 134*b*. Spring means 137 has ends connected to the frame F and the slidable member 136 to normally urge the slidable member in the direction shown by arrow 139. A substantially J-shaped stacker plate 140 has its base portion 140*a* secured upon the top surface of slidable member 136. Upright portion 140*b* has a substantially triangular-shaped periphery as shown best in FIG. 4 to serve as a supporting surface for sheets collected in the outfeed stacker. Shorter arm 140*c* serves as a means for manually gripping and moving the stacker plate 140. The right-hand end 134*b*-1 of the elongated slot 134*b* limits the movement which the stacker plate 140 may undergo in the direction shown by arrow 139.

A pair of hook members 108 and 109 each have a first end swingably mounted near the right-hand ends of guide plates 101 and 102 by virtue of fasteners 108*a* and 109*a* respectively. Elongated slots 108*b* and 109*b* are provided near the free ends of hook members 108 and 109 for cooperating with suitable fastening members provided on the machine frame of the document handling and counting apparatus of the type as shown best, for example, in FIG. 2*a* of the aforementioned U.S. application Ser. No. 618,280. The base member 144 is designed to project beyond cooperating vertical edges 101*a* and 102*a* of side plates 101 and 102 as shown best in FIG. 5 so as to be insertable into a cooperating opening within the frame of document handling and counting device described in aforementioned U.S. application Ser. No. 618,280 to stably and securely join the stacker assembly 100 shown in FIGS. 4–6 to the document handling and counting apparatus.

The acceleration roller 38 and acceleration idler 50 shown in FIG. 2 of U.S. application Ser. No. 618,280 have been reproduced in FIG. 3 of the present application to clearly indicate the physical orientation of the interrelated components as between the document handling and counting apparatus and the outfeed stacker assembly 100 of the present invention. The acceleration roller 38, renumbered roller 151 herein and acceleration idler 50, renumbered 153 herein, form a nip 154 therebetween to move documents along a document path 156. A guide plate 15*c* in the aforementioned U.S. application Ser. No. 618,280, renumbered 158 herein serves to direct documents moving along the path 156 toward the nip 131 formed between final acceleration roller 117 and final acceleration idler 132. The nip 131 which is arranged so that the tangent to the point of contact between members 171 and 132 forms an acute angle similar to angle B of FIG. 1 to alter the direction of feed of a sheet urged through nip 131 from a generally upward diagonal direction to a generally downward diagonal direction as shown by arrow 162. The leading edge of a document moving downstream of nip 131 thereby forms a small acute angle with the concave surface portion of guide plate 130 preferably in the range from 10° to 30°, the leading edge of a sheet passing through nip 131 making contact with guide plate 130 almost immediately thereafter leaving nip 131.

Due to the continuing concave curvature of the portion of guide plate 130 extending between idler 132 and stacker wheels 142, 143, the sheet (even if curled) is caused to move along this concave surface and to enter into the pocket 165 between a pair of adjacent stacker wheel resilient fingers 150. The velocity imparted to the sheets as they leave the influence of final acceleration roller 117 is substantially three times that of the linear velocity of the tips 150*a* of fingers 150 in the region at which a sheet enters into a pocket 165. The sheet is driven deeply into pocket 165 so that its leading edge bottoms against the radially aligned portion 150*b*′ of finger 150′. The sheet-handling operation and the geometry of the stacker wheels are basically the same as was described hereinabove with regard to the embodiment of FIGS. 1 and 2 wherein the fingers impart a curvature to each sheet which is bottomed in a pocket 165 so as to decelerate the sheet and thereby prevent the sheet from bouncing backward. The length of fingers 150, the velocity imparted to sheets by acceleration roller 117 and the distance between the tips 150*a* of the fingers and the nip 131 are chosen to drive a sheet into each pocket 165 so that the sheet bottoms and further so that the sheet bottoms before the radially aligned portion of the finger 150*b* upon which the leading edge of the sheet rests reaches tray surface 134 so that the sheet achieves in a stable condition before it is stripped from its pocket 165.

As was described hereinabove, when the leading edge of the sheet engages the surface of stacker tray 134 it is prevented from any further movement. The fingers 150 continue to revolve about shaft 105 and move below the upper surface of tray 134 causing the sheet to be stripped from its pocket 165. As one example, finger 150″ simply moves away from a sheet captured in a pocket 165 formed between finger 150″ and adjacent finger 150‴. Each of the convex curved surface and extreme tip of finger 150‴ urges the sheet being stripped from pocket 165′ in a generally downward diagonally direction to urge the stripped sheet toward and against the right-hand surface of arm 140*b* stacker plate. FIG. 3 shows a typical alignment stacker plate when a small quantity of sheets which have been delivered to the outfeed stacker tray 134. It can be seen that the sheets can be removed by gripping the upper left or upper right-hand portions of the stack which extend beyond the left or right-hand edges 140*b*-1 and 140*b*-2 of stacker plate 140*b*, enabling a stack of sheets to be removed without moving plate 140 and in fact even during the time the documents are being handled by the document handling and counting apparatus.

The friction drive arrangement guarantees that slippage of the rotary wheels 142 and 143 and the acceleration wheel 117 may occur in the event that a document or any foreign object may become jammed therein. Fingers 150 are formed of a resilient yieldable plastic material to prevent an operator from being injured in the event of any accidental engagement with the fingers. The final acceleration idler assembly 132 also serves to prevent an operator from coming into contact with the acceleration roll 117 while at the same time being resiliently mounted, as was described in connection with the final acceleration idler 32 of FIGS. 1 and 2, to permit slippage of sheets which may be under the simultaneous influence of nip 131 and nip 154 (see FIG. 3). The stacker assembly, in delivering the stacked sheets in a substantially upright manner and to an extremely accessible location, greatly facilitates removal of sheets from the outfeed stacker as well as better exposing the stack being formed as compared with the arrangement described in U.S. application Ser. No. 618,280 which requires that the stacker guide plate 11 (see FIG. 2*a* therein) be lifted and which further requires that the horizontally aligned stack of sheets be lifted from the stacker surface providing a more tedious gripping operation than is the case with the present invention which facilitated arrangement significantly reduces fatigue especially in the case of continuously repetitive counting and stack removing operations performed over a long time span.

The design of the preferred embodiment of FIGS. 3–5 permits a simple straightforward retrofit as between the document handling and counting device described in U.S. application Ser. No. 618,280.

It will be understood that the embodiments described above are merely exemplary and the person skilled in the art may make many variations and modifications without departing from the spirit and scope of the invention. All such modifications and variations are intended to be included within the scope of the invention as defined in the appended claims.

What is claimed is:

1. A stacker apparatus for neatly stacking sheets delivered thereto in serial fashion comprising:

first accelerating means for accelerating sheets in a first direction;

a first guide plate cooperating with said first accelerating means and disposed to engage sheets being delivered to the stacker apparatus for changing the direction of movement of said sheets;

second means for receiving sheets engaged by said first guide plate and for accelerating said sheets in a second direction;

a second curved guide plate;

said second means partially extending through said curved guide plate for directing documents delivered thereto against a concave surface portion of said guide plate wherein the direction of movement of sheets accelerated by said second means is changed and forms an acute angle with said guide plate at the point where the leading edge of the sheet first engages said concave surface whereby the accelerated sheet immediately engages and is caused to closely follow said concave surface portion as it leaves the influence of said first means;

a plurality of rotating stacker wheels;

means for rotating said stacker wheels;

each of said stacker wheels having a plurality of curvilinear fingers arranged at spaced intervals about the periphery of said stacker wheel, said fingers each being formed of a yieldable material and having a first portion extending substantially radially outward from the periphery of said wheel and a second portion extending in a direction which is transverse to said radial portion;

said second portions being curved whereby adjacent fingers cooperatively form a pocket having a curved contour for receiving a sheet delivered into a pocket by said guide plate and for urging said sheet to assume the shape of a pocket;

said curved guide plate having a convex surface portion connected to the downstream end of said concave surface portion for further changing the direction of movement of said sheets and extending at least partially about said stacker wheels and having an opening sufficient to allow said fingers extending therethrough to freely rotate without engaging said curved guide plate, said convex portion curving partially about said stacker wheels being adapted to allow the leading edges of sheets delivered to said stacker wheels by said first means to enter into a pocket between adjacent fingers;

a stacker tray having a stripping portion positioned in the path of the sheet carried by said stacker wheels for stripping the sheets from said pockets as said fingers pass the stripping portion of said stacker tray;

a movable stacker plate being movably arranged along said stacker tray and resilient bias means for urging said stacker plate toward said stacker wheels to hold said sheets in a substantially upright position; and said fingers wipingly engaging the lower portions of the sheets to urge said sheets stripped from the pockets of said wheels toward said stacker plate along the surface of said stripping portion and toward said stacker plate whereby the collection of sheets upon said tray causes said stacker plate to move against said biasing force thereby neatly stacking said sheets and compressing the stacked sheets in the outfeed stacker.

2. The stacker apparatus of claim 1 wherein said second means is constructed to impart a velocity to a sheet which is sufficient to cause the leading edge of the sheet introduced into a pocket to engage the radial portion of one of the fingers defining the pocket before the leading edge of said sheet engages said stacker tray.

3. The stacker apparatus of claim 2 wherein said second means is constructed to impart a linear velocity to a sheet in the range of from 2.5 to 3.5 times as great as the linear velocity of the tips of said fingers in the region in which the leading edges of the sheet enters into a pocket.

4. The stacker apparatus of claim 1 wherein the separation distance between said second means and the point at which the leading edge of a sheet enters a pocket is no greater than the length of a sheet measured in the feed direction.

5. The stacker apparatus of claim 1 wherein said acute angle lies in the range from 0° to 30°.

6. The stacker apparatus of claim 1 wherein said second means comprises a constantly rotating acceleration roller and acceleration idler means rollingly engaging the surface of said acceleration roller wherein the idler means includes resilient mounting means adapted to enable a sheet to experience slippage as it moves through the nip formed by rolling engagement between said acceleration roller and said idler roller assemblies to prevent damage to the sheet in the event of any counteracting forces applied to the sheet either upstream or downstream of said nip.

7. The stacker apparatus of claim 1 further comprising a rotating capstan;

a pulley arm and means for swingably mounting a first end of said arm thereon;

first and second pulleys pivotally mounted on said arm a spaced distance from said first end;

a third pulley adapted to rotate in unison with said stacker wheels;

first resilient belt means entrained about said first and third pulley and urging said swingable arm in a first direction toward said capstan;

a fourth pulley adapted to rotate said acceleration means; and second resilient belt means entrained about said second and fourth pulleys whereby said capstan rotates said stacker wheels and said acceleration means.

8. Apparatus for counting and handling sheets comprising, an input tray receiving a stack of paper sheets;

first means for separating sheets delivered thereto from said input tray into a single-file arrangement and for moving sheets arranged in said single file arrangement in a first direction along a feed path;

second means cooperating with said input tray for delivering the bottommost sheet supported in said input tray towards said first means;

third means for accelerating sheets in said first direction delivered thereto from said first means to create a gap between adjacent sheets moving through said third means and along said feed path;

fourth means for detecting the presence of a gap for counting the separated documents;

said feed path extending between said input tray and said third means moving sheets generally into the interior of said apparatus;

fifth means for receiving sheets and for accelerating said sheets in a second direction toward a stacker apparatus;

a curved guide plate having a first surface portion for deflecting sheets delivered thereto by said third means toward said fifth means;

said fifth means extending partially through said curved guide plate and directing documents delivered thereto against a second concave surface portion of said guide plate wherein the direction of movement of paper sheets accelerated by said fifth means forms an acute angle with said guide plate at the point where the leading edge of the sheet first engages said guide plate surface whereby the accelerated sheet is caused to closely follow said concave surface portion as it leaves the influence of said fifth means;

a plurality of rotating stacker wheels mounted upon a common shaft;

means for rotating said stacker wheels in a first direction;

each of said stacker wheels having a plurality of curvilinear fingers arranged at spaced intervals about the periphery of said stacker wheel, said fingers each being formed of a yieldable material and having a first portion extending substantially radially outward from the periphery of said wheel and a second portion extending in a direction which is transverse to said radial portion and is opposite the direction of rotation of said stacker wheel;

said second portions being curved whereby adjacent fingers cooperatively form a curved pocket region having a curved contour for receiving sheets delivered into a pocket by said guide plate and for urging said sheet to assume the shape of a pocket;

said guide plate having a convex surface portion extending at least partially about said stacker wheels and having an opening sufficient to allow said fingers extending therethrough to freely rotate without engaging said curved guide plate, said convex portion curving partially about said stacker wheels being adapted to allow the leading edges of sheets delivered to said stacker wheels by said first means to enter into a pocket between adjacent fingers;

a stacker tray having a stripping portion positioned in the path of the sheet carried by said stacker wheels for stripping the sheets from said pockets and supporting said sheets as said fingers pass the stripping portion of said stacker tray;

a movable stacker plate being movably arranged along said stacker tray for holding said sheets in an upright position and resilient bias means for urging said stacker plate toward said stacker wheel; and said fingers engaging the lower portions of the sheets to urge the sheets stripped from the pockets of said wheels toward said stacker plate whereby the collection of sheets upon said tray causes said stacker plate to move against said biasing force thereby neatly stacking said sheets and compressing the stacked sheets in the outfeed stacker.

9. The apparatus of claim 8 wherein the path between said third means and said stacker wheels is substantially V-shaped.

10. Stacker apparatus for receiving paper sheets from a document handling and counting apparatus which includes an input tray and means for counting said sheets, means for delivering said counted sheets in a first direction and at a first predetermined velocity away from said input tray, said stacker apparatus comprising:

first accelerating means for accelerating sheets in said first direction;

second accelerating means for receiving sheets and for accelerating said sheets toward the stacker apparatus;

a curved guide plate having an undulating configuration; said second accelerating means extending partially through said curved guide plate for directing documents delivered thereto against a concave surface portion of said guide plate wherein the direction of movement of paper sheets accelerated by said second accelerating means forms an acute angle with said guide plate at the point where the leading edge of the sheet first engages said guide plate surface whereby the accelerated sheet is caused to closely follow said concave surface portion as it leaves the influence of said second acceleration means in a second direction;

a plurality of rotating stacker wheels mounted upon a common shaft;

means for rotating said stacker wheels in a first direction;

each of said stacker wheels having a plurality of curvilinear fingers arranged at spaced intervals about the periphery of said stacker wheel, said fingers each being formed of a yieldable material and having a first portion extending substantially radially outward from the periphery of said wheel and a second portion extending in a direction which is transverse to said radial portion and is opposite the direction of rotation of said stacker wheel;

said second portions being curved whereby adjacent fingers cooperatively form a curved pocket region having a curved contour for receiving sheets delivered into a pocket by said guide plate and for urging said sheet to assume the shape of a pocket;

said guide plate having a convex surface portion extending at least partially about said stacker wheels and having an opening sufficient to allow said fingers extending therethrough to freely rotate without engaging said curved guide plate, said convex portion curving partially about said stacker wheels being adapted to allow the leading edges of sheets delivered to said stacker wheels by said first means to enter into a pocket between adjacent fingers;

a stacker tray having a stripping portion positioned in the path of the sheet carried by said stacker wheels for stripping the sheets from said pockets and supporting said sheets as said fingers pass the stripping portion of said stacker tray;

a movable stacker plate being slidably arranged along said stacker tray for holding said sheets substantially upright and resilient bias means for urging said stacker plate toward said stacker wheels;

said fingers being adapted to urge sheets stripped from the pockets of said wheels along said stripping portion and toward said stacker plate whereby the collection of sheets upon said tray causes said stacker plate to move against said biasing force thereby neatly stacking said sheets and compressing the stacked sheets in the outfeed stacker.

11. The apparatus of claim 10 wherein said stacker apparatus and said input tray are on opposite sides of said document handling and counting apparatus.

12. The stacker apparatus of claim 10, wherein the length of the curved portion of said finger is no greater than the length of a sheet measured in the direction of feeding of the sheets.

13. The stacker apparatus of claim 10, wherein the fingers are adapted to define a pocket entry opening so that the width of the entry opening of each pocket is substantially wide and gradually tapers to the narrowest width at the point of each radially aligned portion of a finger.

14. The stacker apparatus of claim 10, wherein the curved portion of each finger forms an angle with a tangent to said curved guide plate at the point where the free tip of a finger passes said guide plate in the region between said first means and said stacker wheels, which angle is chosen to deflect the leading edge of a sheet into the pocket formed between a pair of adjacent fingers and preventing said sheet from being deflected away from a pocket.

15. The stacker of claim 14, wherein said angle is in the range from 165° to 175°.

16. The stacker apparatus of claim 10, wherein said stacker wheels are comprised of a disc shaped member having an integral cylindrical shaped flange about the outer periphery of said disc member;

a plurality of radially aligned slots arranged at uniform intervals about said periphery, each slot extending inwardly from said periphery and having an enlarged inner end;

each of said fingers having an enlarged free end integral with said radial portion, said enlarged inner end and the end of said radial portion adjacent to said enlarged free end being force-fittingly inserted into an associated one of said slots.

17. The stacker apparatus of claim 16, wherein the cylindrical flange further includes an integral flange portion extending about each of said slots to provide increased surface contact between each slot and an associated finger.

18. Apparatus for turning and stacking sheets, comprising:

first accelerating means for receiving and accelerating sheets and for moving said sheets in a first direction to sheet-turning means;

said sheet-turning means including a first guide plate adapted to be engaged by said sheets for changing the direction of movement of said sheets to a second direction;

said sheet-turning means further including a curved guide plate having a concave surface portion and a convex surface portion and second accelerating means partially extending through said concave surface portion and cooperating with said curved guide plate for further changing the direction of movement of said sheets to a third direction so that said sheets are turned at least 90° relative to the sheets moving in said first direction;

said second accelerating means cooperating with said curved guide plate for accelerating said sheets in said third direction; and means adjacent to said convex surface portion for loosely receiving and holding said sheets in a curved configuration and transferring said turned sheets to a stacker tray which supports said sheets in an upright fashion.

19. Apparatus in accordance with claim 18 wherein said sheet-turning means includes means for turning said sheets upside down, such that said sheets moving in said third direction are upside down relative to the sheets moving in said first direction.

20. Apparatus in accordance with claim 18 wherein said transferring means includes means for orienting said sheets on their edges in a substantially vertical orientation, and said stacker tray being oriented to support and retain said sheets in said vertical orientation.

21. A stacker apparatus for neatly stacking sheets delivered thereto in serial fashion comprising:

first accelerating means for receiving sheets and for accelerating said sheets in a first direction;

a first guide plate disposed to engage sheets accelerated by said first accelerating means for changing the direction of movement of said paper sheets;

a second curved guide plate;

second accelerating means for accelerating and directing documents delivered thereto against a concave surface portion of said second guide plate wherein the direction of movement of paper sheets accelerated by said second means is changed and forms an acute angle with said second guide plate at the point where the leading edge of the sheet first engages said concave surface whereby the accelerated sheet is caused to closely follow said concave surface portion as it leaves the influence of said first means;

a plurality of rotating stacker wheels;

means for rotating said stacker wheels;

each of said stacker wheels having a plurality of curvilinear fingers arranged at spaced intervals about the periphery of said stacker wheel, said fingers each being formed of a yieldable material and having a first portion extending substantially radially outward from the periphery of said wheel and a second portion extending in a direction which is transverse to said radial portion;

said second portions being curved whereby adjacent fingers cooperatively form a curved pocket having a curved contour for receiving a sheet delivered into a pocket by said guide plate and for urging said sheet to assume the shape of a pocket;

said second curved guide plate having a convex surface portion connected to the downstream end of said concave surface portion for further changing the direction of movement of said sheets and extending at least partially about said stacker wheels and having an opening sufficient to allow said fingers extending therethrough to freely rotate without engaging said curved guide plate, said convex portion curving partially about said stacker wheels being adapted to allow the leading edges of sheets delivered to said stacker wheels by said first means to enter into a pocket between adjacent fingers;

a stacker tray having a stripping portion positioned in the path of the sheet carried by said stacker wheels for stripping the sheets from said pockets as said fingers pass the stripping portion of said stacker tray;

a movable stacker plate being movably arranged along said stacker tray and resilient bias means for urging said stacker plate toward said stacker wheels to hold said sheets in a substantially upright position; and said fingers wipingly engaging the lower portions of the sheets to urge said sheets stripped from the pockets of said wheels toward said stacker plate along the surface of said stripping portion and toward said stacker plate whereby the collection of sheets upon said tray causes said stacker plate to move against said biasing force thereby neatly stacking said sheets and compressing the stacked sheets in the outfeed stacker.

22. A stacker apparatus according to any one of claims 1, 18, or 21 wherein said second accelerating means includes a resiliently-mounted member for avoiding jams.

* * * * *

UNITED STATES PATENT AND TRADEMARK OFFICE

CERTIFICATE OF CORRECTION

PATENT NO. : 4,275,874

DATED : June 30, 1981

INVENTOR(S) : JOHN A. DiBLASIO

It is certified that error appears in the above—identified patent and that said Letters Patent is hereby corrected as shown below:

Column 5, line 68, delete "driven" and insert --drive--.

10, line 18, delete "53" and insert --52--.

21, line 25, after "disc" insert -- -shaped--.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*